US011574604B2

(12) United States Patent
Kwon et al.

(10) Patent No.: US 11,574,604 B2
(45) Date of Patent: Feb. 7, 2023

(54) DISPLAY DEVICE AND METHOD FOR DRIVING THE SAME

(71) Applicant: LG Display Co., Ltd., Seoul (KR)

(72) Inventors: Da Hye Kwon, Seoul (KR); Jung Heo, Seoul (KR); Byung Jae Lee, Seoul (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/565,985

(22) Filed: Dec. 30, 2021

(65) Prior Publication Data

US 2022/0208118 A1 Jun. 30, 2022

(30) Foreign Application Priority Data

Dec. 31, 2020 (KR) ..... 10-2020-0189759

(51) Int. Cl.
*G09G 3/3275* (2016.01)

(52) U.S. Cl.
CPC ... *G09G 3/3275* (2013.01); *G09G 2300/0828* (2013.01); *G09G 2310/0289* (2013.01); *G09G 2310/08* (2013.01)

(58) Field of Classification Search
None
See application file for complete search history.

(56) References Cited

U.S. PATENT DOCUMENTS

2019/0378471 A1* 12/2019 Lee ..... G09G 3/3688

FOREIGN PATENT DOCUMENTS

| | | | |
|---|---|---|---|
| KR | 10-0817302 | B1 | 3/2008 |
| KR | 10-2013-0128933 | A | 11/2013 |
| KR | 10-2015-0127500 | A | 11/2015 |
| KR | 10-2018-0066313 | A | 6/2018 |

* cited by examiner

*Primary Examiner* — Christopher J Kohlman
(74) *Attorney, Agent, or Firm* — Birch, Stewart, Kolasch & Birch, LLP

(57) ABSTRACT

A display device can include a display panel configured to display images; and a data driver configured to receive digital data signals, determine a difference value between two consecutive data signals for data voltages to be output based on the digital data signals, change a voltage of the data voltages based on the difference value to generate a changed data voltage, and output the changed data voltage.

18 Claims, 13 Drawing Sheets

DISPLAY DEVICE AND METHOD FOR DRIVING THE SAME

CROSS REFERENCE TO RELATED APPLICATIONS

This application claims priority to Korean Patent Application No. 10-2020-0189759, filed on Dec. 31, 2020, in the Republic of Korea, the entirety of which is hereby incorporated by reference as if fully set forth herein.

BACKGROUND OF THE DISCLOSURE

Field of the Invention

The present disclosure relates to a display device and a method for driving the same.

Discussion of the Related Art

With the further development of information technology, the market for display devices serving as connecting media between users and information is growing. Accordingly, display devices, such as a light emitting display (LED) device, a quantum dot display (QDD) device, and a liquid crystal display (LCD) device, are increasingly being used.

The aforementioned display devices include a display panel including sub-pixels, a driver that outputs driving signals for driving the display panel, a power supply for generating power to be supplied to the display panel or the driver, and the like.

The aforementioned display devices can display images in such a manner that selected sub-pixels transmit light or directly emit light when driving signals, for example, a scan signal and a data signal, are supplied to the sub-pixels formed in the display panel. Also, displays become even larger and have even higher definition (e.g., UHD display devices), the configuration may have difficulty in securing an adequate charging rate and image quality may suffer or deteriorate.

SUMMARY OF THE DISCLOSURE

Accordingly, the present disclosure is directed to a display device and a method for driving the same that substantially obviate one or more problems due to limitations and disadvantages of the related art.

According to an embodiment of the present disclosure, the present invention can increase a charging rate of a data voltage output from a data driver using a difference between two consecutive data signals or varies the charging rate to secure a certain level of charging rate and easily realizes a large-screen/high-definition display device using the charging rate.

To achieve these objects and other advantages and in accordance with purposes of the invention, as embodied and broadly described herein, a display device includes a display panel configured to display images and a data driver configured to drive the display panel, in which the data driver performs voltage change of reflecting a difference value between two consecutive data signals in a data voltage to be output.

The data driver can perform a voltage change of reflecting the difference value in the data voltage to be output for a horizontal time required to prepare data voltages corresponding to one line.

The difference value can be reflected in an initial period of the horizontal time.

A period in which the difference value is reflected in the data voltage to be output can be fixed or variable in the horizontal time.

The data driver can include a first circuit configured to subtract a data signal stored in a latch from a data signal stored in the first latch to obtain the difference value, and a second circuit configured to reflect the difference value in the data signal to be output from the second latch.

The second circuit can reflect the difference value in the data signal stored in the second latch and output the data signal in which the difference value has been reflected in a first period of the horizontal time, and output the data signal stored in the second latch without changing the data signal in a second period of the horizontal time.

The first circuit can include a subtractor configured to subtract the data signal stored in the second latch of the data driver from the data signal stored in the first latch of the data driver to obtain the difference value and a delay configured to delay an output time of the difference value output from the subtractor, and the second circuit can include an adder configured to reflect the difference value output from the subtractor in the data signal output from the second latch and a selector configured to output the data signal stored in the second latch without changing the data signal or to output the data signal in which the difference value has been reflected by the adder.

The second circuit can output the data signal stored in the second latch without changing the data signal or output the data signal in which the difference value has been reflected by the adder in response to a circuit control signal output from a timing controller configured to control the data driver.

The second circuit can fix or vary a time in which the difference value is reflected in the data signal stored in the second latch in response to the circuit control signal.

The data voltage output from the data driver can have at least two different levels for the horizontal time.

In another aspect of the present invention, a method for driving a display device including a display panel configured to display images and a data driver configured to drive the display panel includes subtracting a data signal stored in a second latch of the data driver from a data signal stored in a first latch of the data driver to obtain a difference value, reflecting the difference value in the data signal output from the second latch, and converting the data signal in which the difference value has been reflected into an analog data voltage and outputting the analog data voltage.

The reflecting of the difference value may include outputting the data signal in which the difference value has been reflected or outputting the data signal stored in the second latch without changing the data signal.

The difference value can be reflected in an initial period of a horizontal time required to prepare data voltages corresponding to one line.

The reflecting of the difference value can include fixing or varying a time in which the difference value is reflected in the data signal stored in the second latch.

BRIEF DESCRIPTION OF THE DRAWINGS

The accompanying drawings, which are included to provide a further understanding of the invention and are incorporated in and constitute a part of this application, illustrate embodiment(s) of the present invention and together with the description serve to explain principles of the invention. In the drawings.

DETAILED DESCRIPTION OF THE EMBODIMENTS

A display device according to embodiments of the present disclosure can be implemented as a television set, a video player, a personal computer (PC), a home theater system, a vehicle electrical device, a smartphone, or the like but the present invention is not limited thereto. The display device according to embodiments of the present disclosure can be implemented as a light-emitting display device (LED), a quantum dot display device (QDD), or a liquid crystal display device (LCD).

However, a light-emitting display device that displays images by directly emitting light will be exemplified below for convenience of description (e.g., OLED display devices). Although light-emitting display devices can be implemented based on inorganic light-emitting diodes (LEDs) or organic LEDs, a light-emitting display device based on organic LEDs will be exemplified below for convenience of description.

Figure 1:
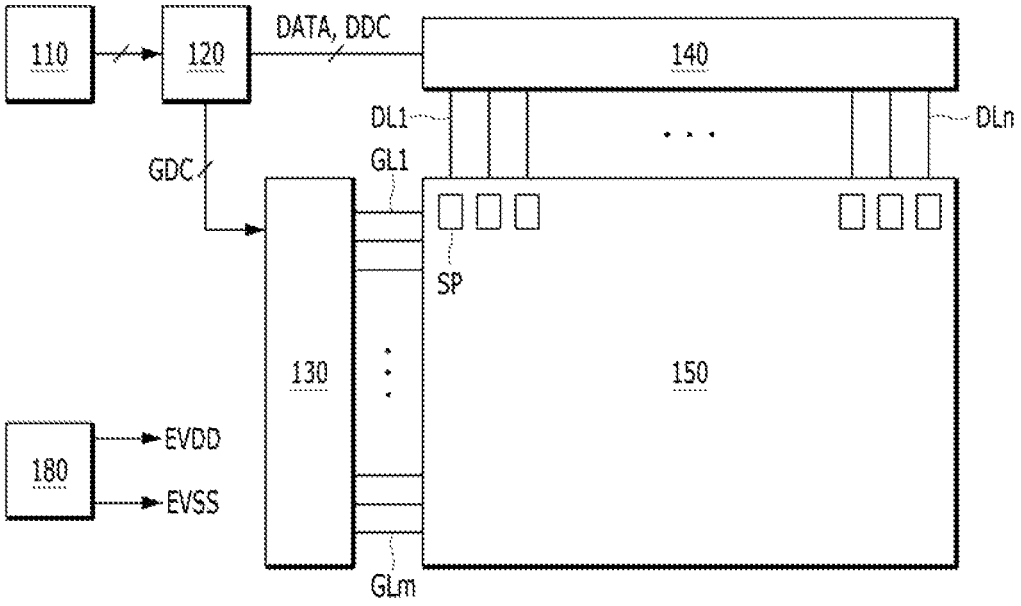
FIG. 1 is a block diagram schematically illustrating a configuration of a light-emitting display device according to an embodiment of the present disclosure.
Figure 2:
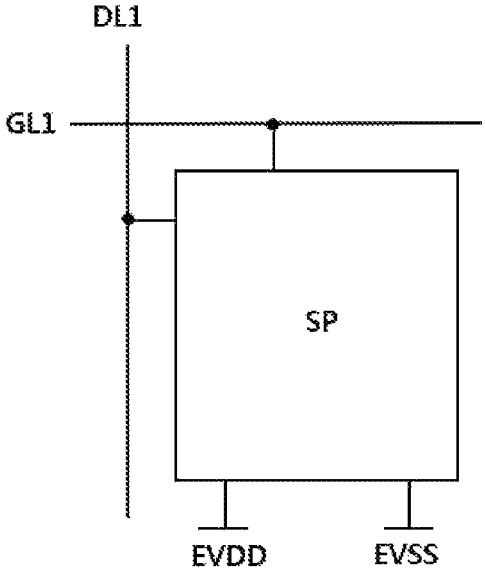
FIG. 2 is a block diagram schematically illustrating a sub-pixel included in a display panel according to an embodiment of the present disclosure.
Figure 3:
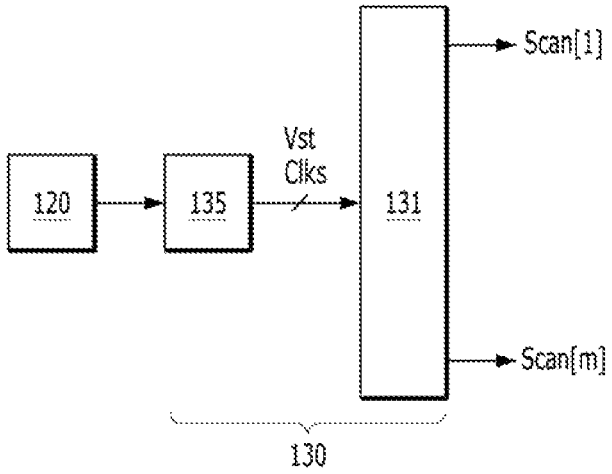
FIG. 3 illustrates a configuration of a device related to a gate-in-panel scan driver according to an embodiment of the present disclosure.
Figure 4A:
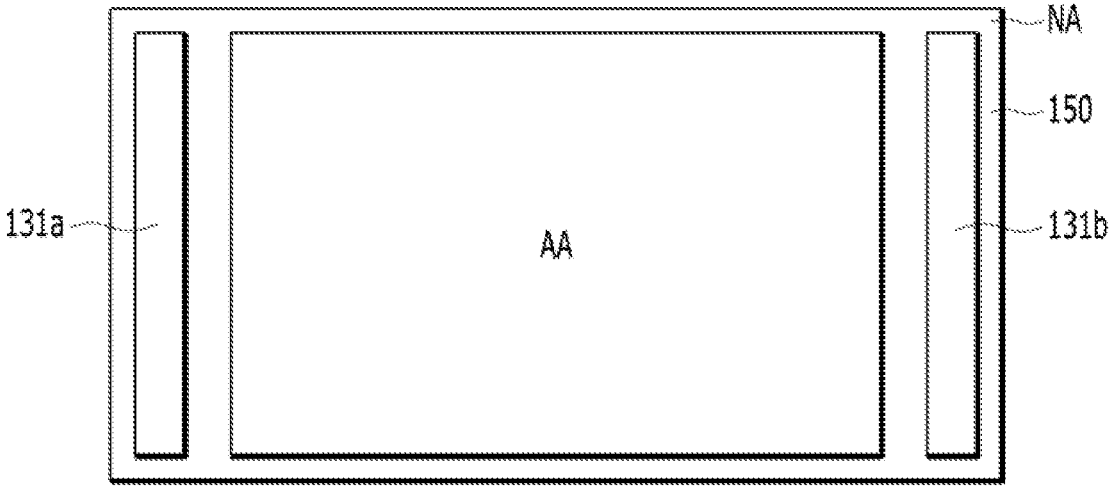
FIGS. 4A and 4B illustrate arrangements of the gate-in-panel scan driver according to embodiments of the present disclosure.
Figure 4B:
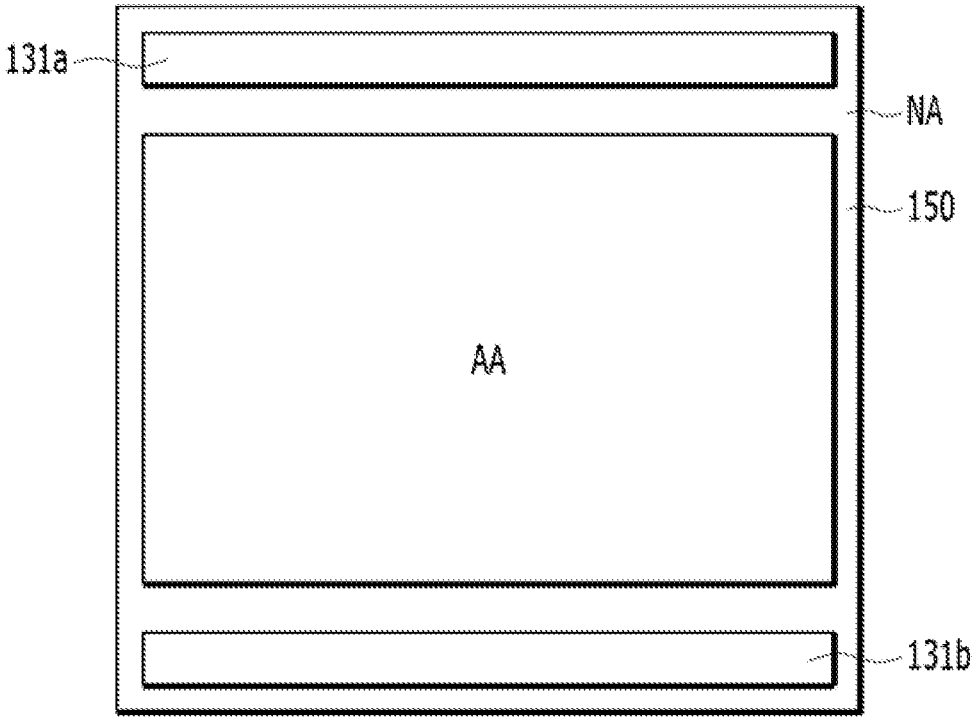
Figure 5:
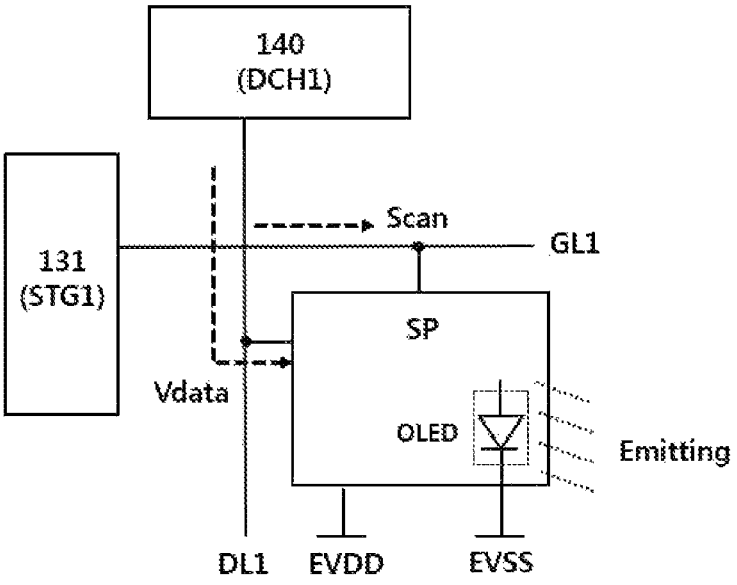
FIG. 5 is a diagram for briefly showing a light-emitting operation of a sub-pixel according to an embodiment of the present disclosure.

FIG. 1 is a block diagram schematically illustrating a configuration of a light-emitting display device, FIG. 2 is a block diagram schematically illustrating a sub-pixel included in a display panel of FIG. 1, FIG. 3 illustrates a configuration of a device related to a gate-in-panel scan driver, FIG. 4 illustrates an arrangement of the gate-in-panel scan driver, and FIG. 5 is a diagram for briefly showing a light-emitting operation of a sub-pixel.

As illustrated in FIG. 1 to FIG. 5, the light-emitting display device can include an image provider 110, a timing controller 120, a scan driver 130, a data driver 140, a display panel 150, and a power supply 180.

The image provider 110 (or a host system) can output various driving signals along with an image data signal supplied from the outside or an image data signal stored in an internal memory. The image provider 110 can provide a data signal and various driving signals to the timing controller 120.

The timing controller 120 can output a gate timing control signal GDC for controlling operation timing of the scan driver 130, a data timing control signal DDC for controlling operation timing of the data driver 140, and various synchronization signals (a vertical synchronization signal Vsync and a horizontal synchronization signal Hsync). The timing controller 120 can provide a data signal DATA supplied from the image provider 110 along with the data timing control signal DDC to the data driver 140. The timing controller 120 can be configured as an integrated circuit (IC) and can be mounted on a printed circuit board, but the present invention is not limited thereto.

The power supply 180 can transform external power into first power at a high level and second power at a low level under the control of the timing controller 120 and output the first power and the second power through a first power line EVDD and a second power line EVSS. The power supply 180 can generate and output voltages (e.g., gate voltages including a gate high voltage and a gate low voltage) necessary for operation of the scan driver 130 and voltages (e.g., drain voltages including a drain voltage and a half drain voltage) necessary for operation of the data driver 140 as well as the first power and the second power.

The data driver 140 can sample and latch a data signal DATA in response to the data timing control signal DDC supplied from the timing controller 120, convert the data signal in a digital form into a data voltage in an analog form based on a gamma reference voltage, and output the data voltage. The data driver 140 can provide the data voltage to the sub-pixels included in the display panel 150 through data lines DL1 to DLn where n can be a positive number such as a positive integer. The data driver 140 can be formed in the form of an IC and mounted on the display panel 150 or mounted on a printed circuit board, but the present invention is not limited thereto.

The scan driver 130 can output a scan signal (or a scan voltage) in response to the gate timing control signal GDC supplied from the timing controller 120. The scan driver 130 can provide the scan signal to the sub-pixels included in the display panel 150 through scan lines GL1 to GLm where m can be a positive number such as a positive integer. The scan driver 130 can be formed in the form of an IC or directly formed on the display panel 150 in a gate in panel structure.

The gate-in-panel scan driver 130 can include a shift register 131 and a level shifter 135. The level shifter 135 can generate and output one or more clock signals Clks and a start signal Vst based on signals output from the timing controller 120. The clock signals Clks can be generated and output in the form of K different phases, such as 2 phases, 4 phases, or 8 phases (K being an integer equal to or greater than 2).

The shift register 131 operates based on the signals Clks and Vst output from the level shifter 135 and can output scan signals Scan[1] to Scan[m] for turning on or off thin film transistors formed in the display panel 150. The shift register 131 is formed in the form of a thin film on the display panel 150 in a gate in panel structure.

The shift register 131 can be generally arranged in a non-display area NA of the display panel 150. Here, the shift register 131 can be arranged in left and right non-display areas NA of the display panel 150, as shown in FIG. 4A or can be arranged in upper and lower non-display areas NA of the display panel 150, as shown in FIG. 4B.

Although FIG. 4 illustrates examples in which a first shift register 131*a* and a second shift register 131*b* are arranged in the non-display areas NA on the left and right sides or upper and lower sides of a display area AA, only a single shift register can be arranged in the left, right, upper, or lower non-display area NA. Further, the shift register can be divided and arranged in the non-display area NA and the display area AA or can be arranged in the display area AA in a distributed manner.

In addition, the level shifter 135 can be formed in the form of an independent IC or can be included in the power supply 180 distinguished from the shift register 131. However, this is merely an example, and the display device can be implemented in various forms such as a configuration in which at least one of the timing controller 120, the scan driver 130, and the data driver 140 is integrated in a single IC according to a light-emitting display device implementation method.

The display panel 150 can operate in connection with the scan driver 130, the data driver 140, and the power supply 180 and display images. The display panel 150 can be manufactured based on a rigid or flexible substrate, such as a glass substrate, a silicon substrate, or a polyimide substrate. The display panel 150 can include sub-pixels that directly emit light (self-emission). The sub-pixels can include red, green and blue pixels or red, green, blue, and white pixels.

A single sub-pixel SP can be connected to a first data line DL1, a first scan line GL1, the first power line EVDD, and the second power line EVSS. A single sub-pixel SP can include an OLED emitting light. Further, a single sub-pixel SP can include a switching transistor, a driving transistor, and a capacitor. The switching transistor can be turned on or off in response to a scan signal Scan output from a first stage STG1 included in the scan driver 130. A data voltage Vdata output from a first output channel DCH1 of the data driver 140 can be stored in the capacitor according to turn-on operation of the switching transistor. The driving transistor can generate a driving current to be supplied to the OLED based on the data voltage Vdata stored in the capacitor. The OLED can perform a light-emitting operation based on the driving current. Also, a single sub-pixel can include a circuit for compensating for deterioration of the driving transistor as well as the OLED.

Figure 6:
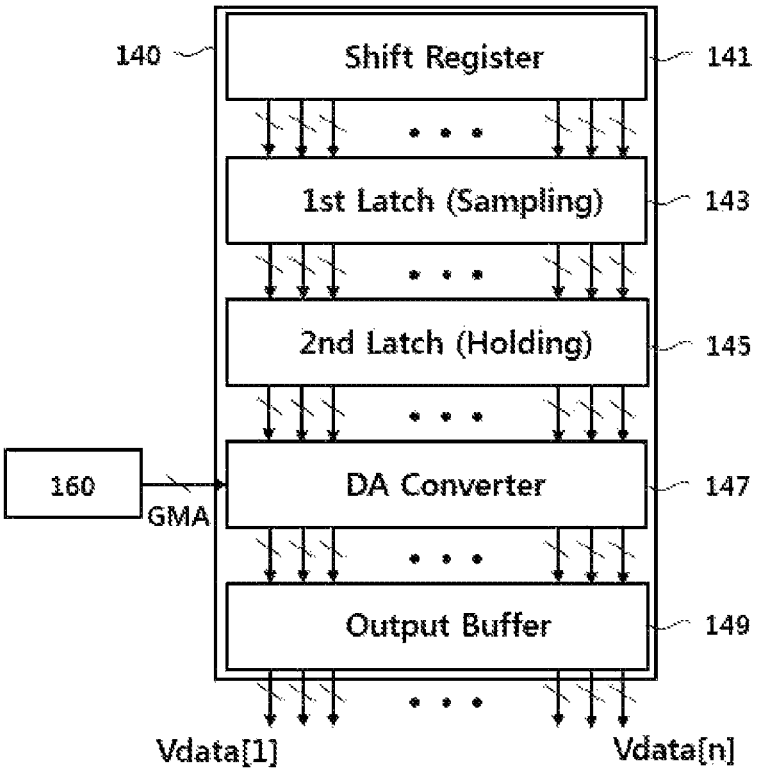
FIG. 6 is a block diagram schematically illustrating internal blocks of a data driver according to an embodiment of the present disclosure.
Figure 7:
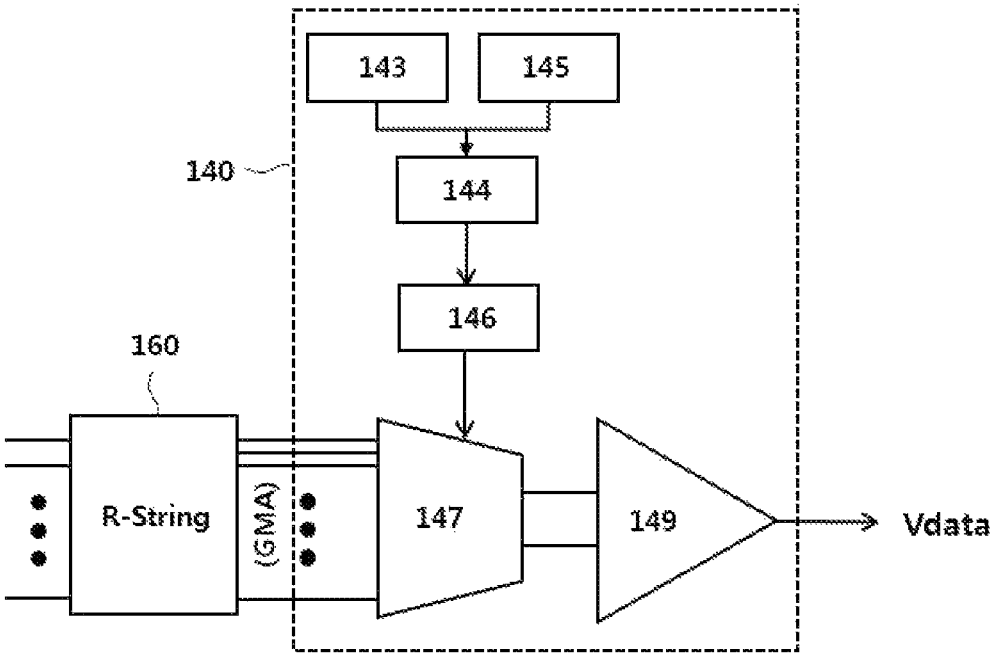
FIG. 7 is a block diagram for describing a data driver according to an embodiment of the present disclosure.
Figure 8:
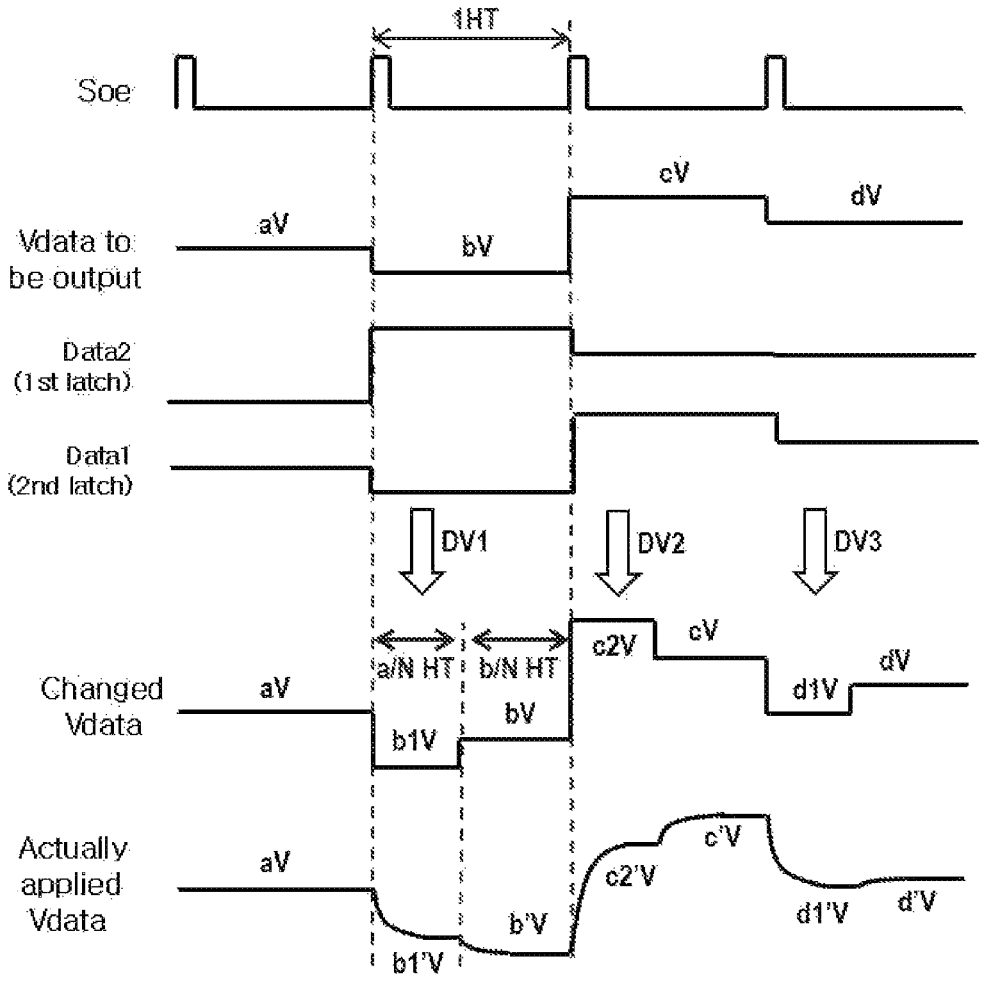
FIG. 8 is a waveform diagram for describing characteristics of the data driver according to an embodiment of the present disclosure.

FIG. 6 is a block diagram schematically illustrating internal blocks of the data driver, FIG. 7 is a block diagram for describing a data driver according to a first embodiment of the present invention, and FIG. 8 is a waveform diagram for describing characteristics of the data driver according to the first embodiment of the present invention.

As illustrated in FIG. 6, the data driver 140 can include a shift register 141, a first latch (sampling latch) 143, a second latch (holding latch) 145, a digital to analog (DA) converter 147, and an output unit 149 (e.g., output buffer).

The shift register 141 can receive digital data signals transmitted from the timing controller line by line, shift the digital data signals and output the shifted digital data signals.

The first latch 143 can sample the digital data signals output from the shift register 141 and then output sampled signals. The first latch 143 can be referred to as a sampling latch because the first latch 143 serves to sample data signals.

The second latch 145 can hold the digital data signals output from the first latch 143 and then output the signals. The second latch 145 can be referred to as a holding latch because the second latch 145 serves to hold (maintain) data signals.

The DA converter 147 can convert a digital data signal output from the second latch 145 into an analog data voltage and then output the analog data voltage. The DA converter 147 can convert the digital data signal into the analog data voltage based on a gamma reference voltage GMA output from a gamma unit 160.

The output unit 149 can output analog data voltages Vdata[1] to Vdata[n] converted by the DA converter 147 through output channels. The output unit 149 (e.g., output buffer) can be implemented as an amplifier AMP. The data voltages Vdata[1] to Vdata[n] output from the output unit 149 can be applied to sub-pixels through data lines.

As illustrated in FIG. 7 and FIG. 8, to increase a charging rate of data voltages, the data driver 140 can change data voltages Vdata to be output to the display panel and then output the changed data voltages.

The data driver 140 can operate such that difference values DV1, DV2, and DV3 that are differences between data signals Data2 and Data1 stored in the first latch 143 and the second latch 145 are reflected in the data voltages Vdata to be output and then the data voltages Vdata are output.

The data driver 140 can operate such that the difference values DV1, DV2, and DV3 are reflected in the data voltages Vdata to be output in a period of a horizontal time 1 HT in which data voltages corresponding to one line (e.g., for a sub-pixel connected to one data line or a group of sub-pixels connected to a same data line) are output in response to a source output enable signal Soe (e.g., the horizontal time 1 HT can correspond to one period/one cycle of the gate pulse or scan signal from the gate driver). The operation of the data driver 140 will be described in more detail.

The data driver 140 can include a first circuit 144 and a second circuit 146 disposed between the second latch 145 and the DA converter 147. The first circuit 144 and the second circuit 146 are added to increase a charging rate of data voltages output from the data driver 140.

The first circuit 144 can subtract the data signal Data1 stored in the second latch 145 from the data signal Data2 stored in the first latch 143 and then obtain the difference values DV1, DV2, and DV3 that are differences between these data signals.

The second circuit 146 can reflect the difference values DV1, DV2, and DV3 output from the first circuit 144 in the data signal Data1 output from the second latch 145 to obtain a changed data signal. The data signal changed according to the operation of the second circuit 146 can be applied to the DA converter 147.

The DA converter 147 can convert the digital data signal output from the second circuit 146 into analog data voltages based on the gamma reference voltage GMA supplied from the gamma unit 160 and output the analog data voltages.

The data voltages output from the DA converter 147 can be applied to data lines through the output unit 149. The data voltages output through the output unit 149 can correspond to data voltages Vdata changed through the aforementioned process and actually applied data voltages Vdata' can correspond to data voltages actually applied to the display panel. For example, the embodied invention can provide compensated data voltages to increase the charging rate and provide a better response time.

The gamma unit 160 (e.g., gamma circuit part) can be configured to provide a gamma reference voltage GMA at various levels based on a resistance string R-String and can be positioned inside or outside the data driver 140 or partly positioned inside and outside the data driver 140.

As the first circuit 144 and the second circuit 146 are added, the data driver 140 can operate through the following flow. First, the data driver 140 can subtract the data signal Data1 stored in the second latch 145 from the data signal Data2 stored in the first latch 143 to obtain the difference values DV1, DV2, and DV3. Then, the data driver 140 can divide a horizontal time 1 HT for outputting data voltages corresponding to one line (e.g., for a sub-pixel connected to one data line or a group of sub-pixels connected to a same data line) in response to the source output enable signal Soe into a first period a/N HT (N being an integer equal to or greater than 1, a being an integer equal to or less than N) and a second period b/N HT (N being an integer equal to or greater than 1, b being an integer equal to or less than N). Thereafter, the data driver 140 can reflect the difference values DV1, DV2, and DV3 in a data signal to be output in the first period a/N HT to obtain a changed data signal. Then, the data driver 140 can convert the changed data signal into an analog data signal and output the analog data signal as changed data voltages Vdata.

Through the above-described flow, data voltages Vdata to be output, such as bV, cV, and dV (b, c, and d being different voltage levels), can be changed such that bV is output as b1V and bV, cV is output as c2V and cV, and dV is output as d1V and dV. In addition, the changed data voltages Vdata including b1V, bV, c2V, cV, d1V, and dV can be output from the data driver 140, applied to the display panel, and then detected in the form of actually applied data voltages Vdata' including b1'V, b'V, c2'V, c'V, d1'V, and d'V.

As can be ascertained from the above description, a level decrease and a level increase, such as the first difference value DV1 (level decrease), the second difference value DV2 (level increase), and the third difference value DV3 (level decrease), are reflected in data voltages Vdata, such as bV, cV, and dV for the first period a/N HT, and thus bV, cV, and dV can be respectively changed to b1V, c2V, and d1V.

However, the level increase or the level decrease is reflected in the data voltages Vdata to be output only in the first period a/N HT and it is not reflected in the data voltages Vdata in the second period b/N HT. Accordingly, the data voltages Vdata to be output can include voltages changed and output in the first period a/N HT and voltages that are output without being changed in the second period b/N HT.

In addition, as can be ascertained from the data voltages Vdata' actually applied to the display panel, charging/discharging differences can be present between the changed data voltages Vdata and the actually applied data voltages Vdata' due to RC (a resistance component and a capacitance component) of the display panel, as represented by b1'V, b'V, c2'V, c'V, d1'V, and dV'. However, this can depend on RC characteristics of the display panel.

According to the first embodiment of the present invention, a data voltage output from the data driver 140 can be output as at least two different levels, such as a first level (e.g., b1V) and a second level (e.g., bV), instead of being output as a single data voltage level for a horizontal time 1 HT for outputting data voltages corresponding to one line. In other words, the embodied invention can provide a finer granularity of control by providing at least two different voltage levels during the same horizontal time IHT. In addition, a charging rate of data voltages can be improved according to the influence of changed data voltages (a level increase/decrease effect due to reflection of difference values between latches in data voltages to be output) in the first period a/N HT corresponding to an initial period of the horizontal time HT. That is, the data driver 140 according to the first embodiment of the present invention can change voltages by reflecting difference values in data voltages to be output only in the initial period of the horizontal time 1 HT required to prepare data voltage corresponding to one line (e.g., for a sub-pixel connected to one data line or a group of sub-pixels connected to a same data line).

Figure 9:
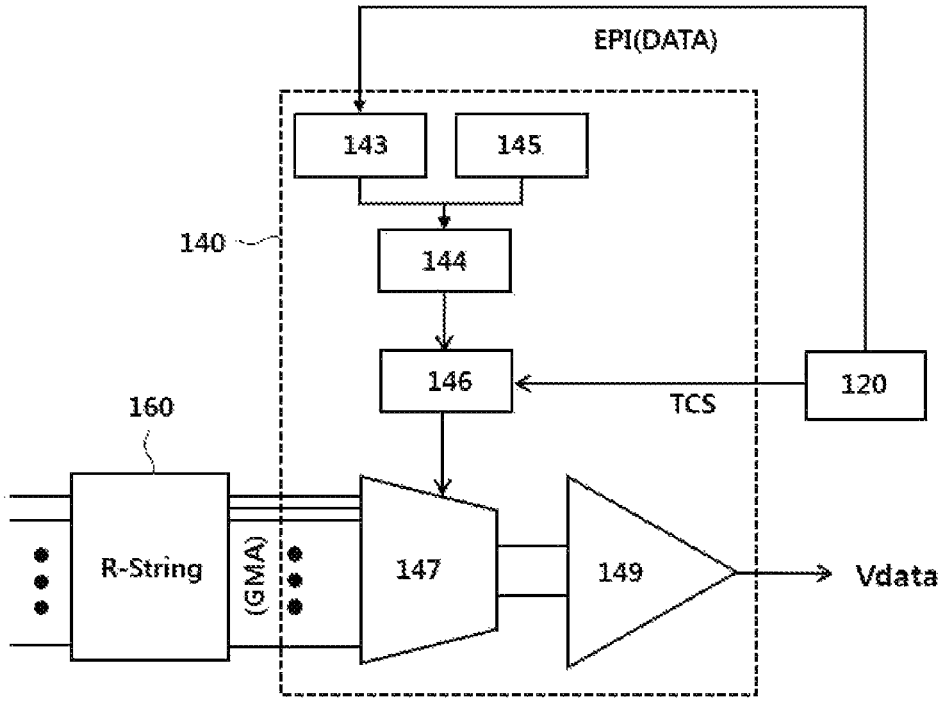
FIG. 9 is a block diagram for describing a data driver according to another embodiment of the present disclosure.
Figure 10:
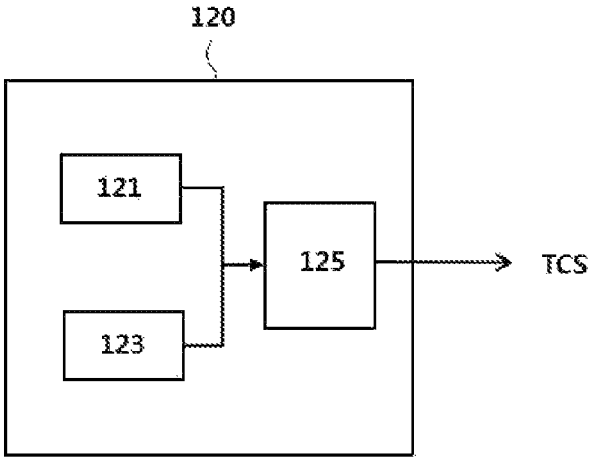
FIG. 10 is a diagram illustrating internal blocks of a timing controller illustrated in FIG. 9 according to an embodiment of the present disclosure.

FIG. 9 is a block diagram for describing a data driver according to a second embodiment of the present invention, FIG. 10 is a diagram illustrating internal blocks of a timing controller illustrated in FIG. 9, and FIG. 11 to FIG. 13 are waveform diagrams for describing characteristics of the data driver according to the second embodiment of the present invention. Hereinafter, the second embodiment will be described focusing on parts modified from or added to those of the first embodiment.

As illustrated in FIG. 9 and FIG. 10, the data driver 140 can receive a digital data signal DATA based on an interface EPI connected to the timing controller 120. Here, the data driver 140 and the timing controller 120 are connected to an embedded clock point-point interface (EPI), but the present invention is not limited thereto.

In addition, the data driver 140 can receive a circuit control signal TCS from the timing controller 120 and control the second circuit 146 based on the circuit control signal TCS. Here, the circuit control signal TCS can be received through an additionally configured interface or received based on the EPI, but the present invention is not limited thereto.

The timing controller 120 can include memories 121 and 123 capable of temporarily storing a data signal to be applied to the first latch 143 and a data signal to be applied to the second latch 145, and a control signal generator 125 for generating the circuit control signal TCS based on the data signals stored in the memories 121 and 123.

The control signal generator 125 can calculate charging rate change with respect to each horizontal line based on difference values obtained by subtracting the data signal to be applied to the second latch 145 from the data signal to be applied to the first latch 143, and change the circuit control signal TCS based on the charging rate change. Although FIG. 10 shows an example in which the data signal to be applied to the first latch 143 and the data signal to be applied to the second latch 145 are separately stored in a first bank and a second bank of a single memory, the present invention is not limited thereto.

Figure 11:
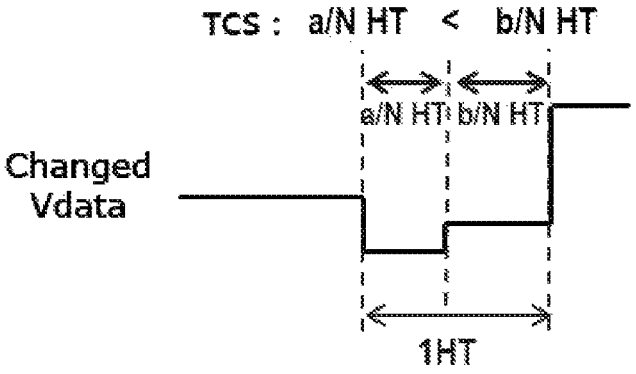
FIG. 11 to FIG. 13 are waveform diagrams for describing characteristics of the data driver according to an embodiment of the present disclosure.

As illustrated in FIG. 10 and FIG. 11, the timing controller 120 can configure the circuit control signal TCS such that the proportion of the second period b/N HT is greater than the proportion of the first period a/N HT and output the circuit control signal TCS. When the circuit control signal TCS as shown in FIG. 11 is output from the timing controller 120, a time in which the data driver 140 outputs data voltages without changing the same can become longer than a time in which the data driver 140 changes the data voltages. That is, when the circuit control signal TCS as shown in FIG. 11 is output, the data driver 140 can increase the proportion of the second period b/N HT (e.g., the first period a/N HT is less than the second period b/N HT).

Figure 12:
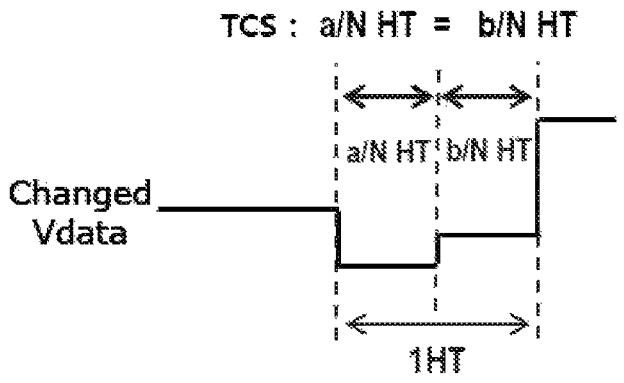

As illustrated in FIG. 10 and FIG. 12, the timing controller 120 can configure the circuit control signal TCS such that the proportion of the second period b/N HT is identical to the proportion of the first period a/N HT and output the circuit control signal TCS. When the circuit control signal TCS as shown in FIG. 12 is output from the timing controller 120, a time in which the data driver 140 changes data voltages can become identical to a time in which the data driver 140 outputs the data voltages without changing the same. That is, when the circuit control signal TCS as shown in FIG. 12 is output, the data driver 140 can cause the proportion of the first period a/N HT to be identical to the proportion of the second period b/N HT (e.g., the first period a/N HT is equal to the second period b/N HT).

Figure 13:
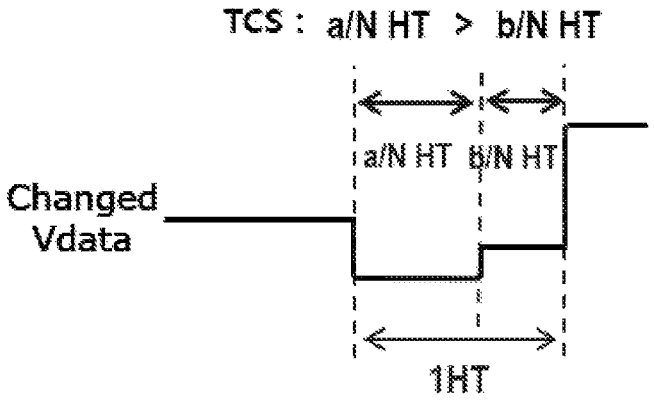

As illustrated in FIG. 10 and FIG. 13, the timing controller 120 can configure the circuit control signal TCS such that the proportion of the first period a/N HT is greater than the proportion of the second period b/N HT and output the circuit control signal TCS. When the circuit control signal TCS as shown in FIG. 13 is output from the timing controller 120, a time in which the data driver 140 changes data voltages can become longer than a time in which the data driver 140 outputs the data voltages without changing the same. That is, when the circuit control signal TCS as shown in FIG. 13 is output, the data driver 140 can increase the proportion of the first period a/N HT (e.g., the first period a/N HT is greater than the second period b/N HT).

In this manner, the second circuit 146 and the like of the data driver 140 can vary a time in which difference values are reflected in data voltages to be output based on the circuit control signal TCS output from the timing controller 120. Accordingly, a data change time in which a charging rate of data voltages can be determined can be controlled by the timing controller 120 although data voltages to be output are changed by the data driver 140. That is, the charging rate of data voltages can be fixed to a predetermined value or varied in response to the size or charging characteristics of the display panel under the control of the timing controller 120.

According to the second embodiment of the present invention, the data driver can change voltages in order to improve a charging rate of data voltages and the proportion of a time in which the voltages are changed can be controlled by the timing controller. Accordingly, the charging rate can be varied in response to the size of the display panel according to the data driver and the timing controller operating in connection with each other.

Figure 14:
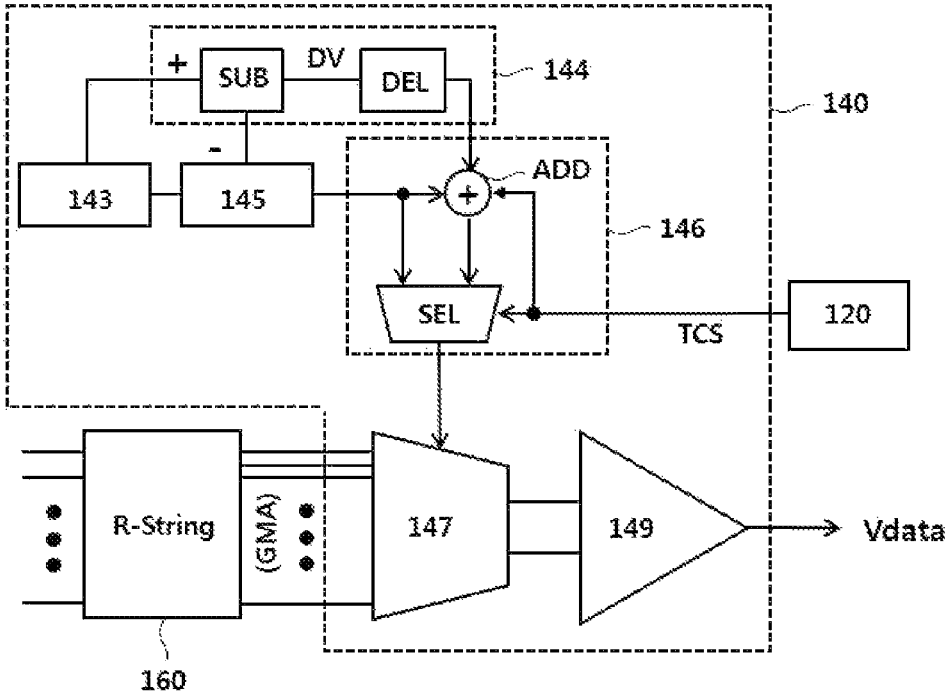
FIG. 14 is a block diagram for describing a data driver according to another embodiment of the present disclosure.
Figure 15:
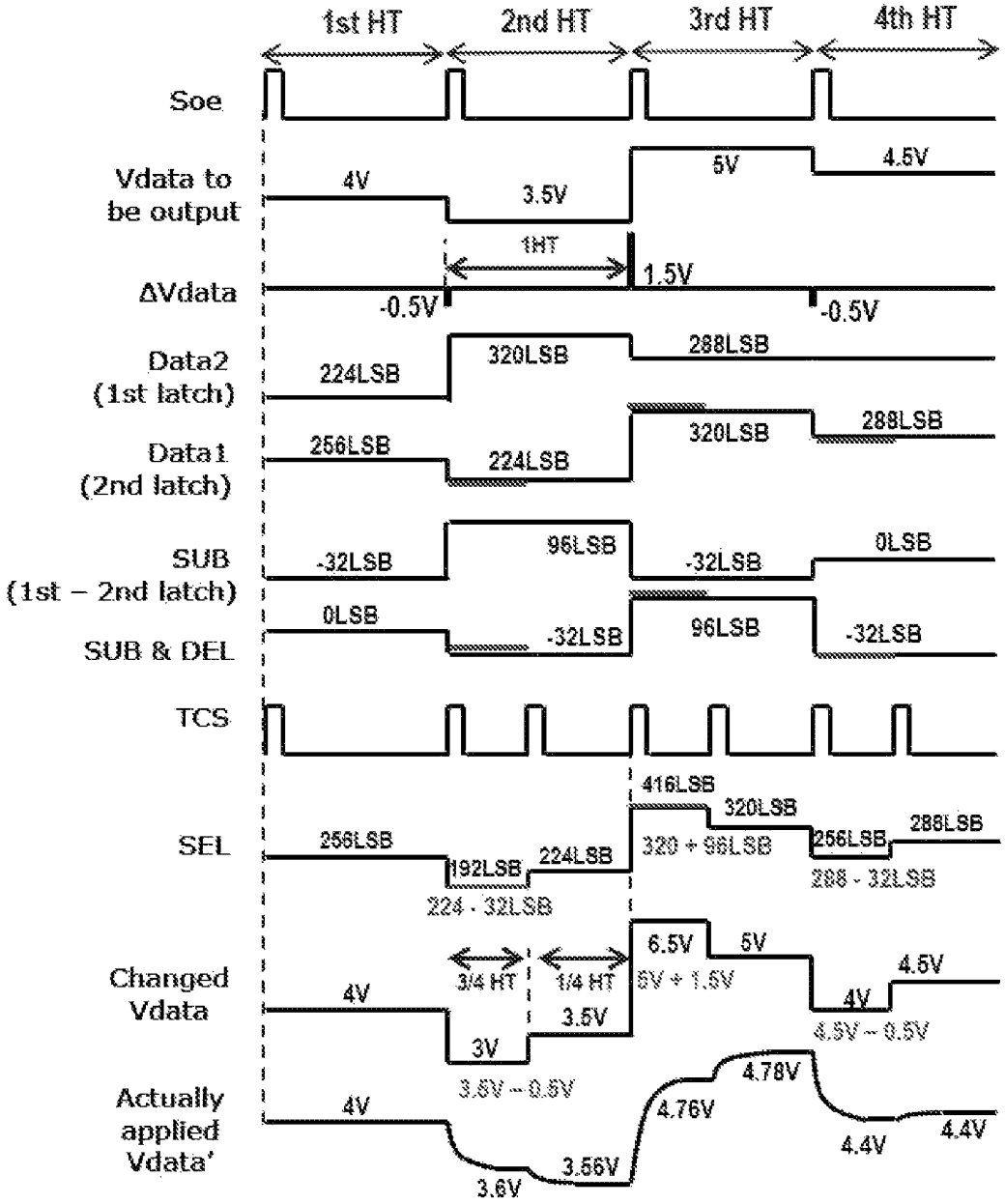
FIG. 15 is a waveform diagram for describing characteristics of the data driver according to an embodiment of the present disclosure.

FIG. 14 is a block diagram for describing a data driver according to a third embodiment of the present invention, and FIG. 15 is a waveform diagram for describing characteristics of the data driver according to the third embodiment of the present invention.

As illustrated in FIG. 14 and FIG. 15, the first circuit 144 can include a subtractor SUB and a delay DEL. The second circuit 146 can include an adder ADD and a selector SEL.

The subtractor SUB can subtract a data signal Data1 stored in the second latch 145 from a data signal Data2 stored in the first latch 143 to obtain a difference value DV.

The delay DEL can delay an output time of the difference value DV output from the subtractor SUB such that the difference value DV output from the subtractor SUB and the data signal Data1 stored in the second latch 145 are applied to the adder ADD at the same output time. When the subtractor SUB can calculate the difference value DV within a short time, the delay DEL can be omitted.

On the other hand, if the output time of the data signal Data1 stored in the second latch 145 is ahead of a time when the difference value DV is calculated, the delay DEL can be disposed between the second latch 145 and the adder ADD.

In this manner, the delay DEL serves to control time such that the difference value DV output from the subtractor SUB and the data signal stored in the second latch 145 are applied to the adder ADD at the same output timing, and thus the delay DEL can be disposed at any position where the delay DEL can control the output timing.

The adder ADD can reflect the difference value DV output from the subtractor SUB in a data signal, that is, data voltages to be output, output from the second latch 145, that is, add the difference value DV to the data voltages. The adder ADD can reflect the difference value DV in the data voltages to be output in the first period between the first period and the second period of 1 horizontal time (e.g., 1 HT) as described in the first embodiment. However, the time in which the difference value DV can be reflected in the data voltages to be output can be varied in response to the circuit control signal TCS output from the timing controller 120, as described in the third embodiment.

The selector SEL can output the data signal, that is, the data voltages Vdata to be output, stored in the second latch 145 without changing the data voltages Vdata or can output data voltages Vdata changed by the adder ADD. The selector SEL can output the data signal, that is, the data voltages Vdata to be output, output from the second latch 145 without changing the data voltages Vdata or can output data voltages Vdata changed by the adder ADD in response to the circuit control signal TCS output from the timing controller 120.

The DA converter 147 can convert a data signal output from the second circuit 146 into analog data voltages and output the analog data voltages based on the gamma reference voltage GMA supplied from the gamma unit 160, and the analog data voltages output from the DATA converter 147 can be amplified by the output unit 149 and output. The data voltages output through the output unit 149 correspond to the changed data voltages Vdata.

Hereinafter, output of the changed data voltages Vdata when one of the data voltages Vdata to be output is 3.5 V according to the third embodiment of the present invention will be described.

Here, an example in which a data voltage to be output for a first horizontal time 1st HT is 4 V, a data voltage to be output for a second horizontal time 2nd HT is 3.5 V, a data voltage to be output for a third horizontal time 3rd HT is 5 V, and a data voltage to be output for a fourth horizontal time 4th HT is 4.5 V is described. In addition, an example in which data voltages are changed from the second horizontal time 2nd HT is described in order to show a change in the data voltages after the first horizontal time 1st HT. Furthermore, since data voltage changes during the second horizontal time 2nd HT and the third horizontal time 3rd HT can be understood from data voltage change during the first horizontal time 1st HT and the second horizontal time 2nd HT, only one example will be described.

When the data signal Data1 stored in the second latch 145 is subtracted from the data signal Data2 stored in the first latch 143 for the first horizontal time 1st HT (224 LSB−256 LSB), a subtraction value Sub of −32 LSB is obtained. The selector SEL can output the data signal Data1 (256 LSB) stored in the second latch 145 without changing the data signal Data1 because data voltages are not changed for the first horizontal time 1st HT. As a result, a changed data voltage Vdata and an actually applied data voltage Vdata can appear as 4 V.

When the data signal Data1 stored in the second latch 145 is subtracted from the data signal Data2 stored in the first latch 143 for the second horizontal time 2nd HT (320 LSB−224 LSB), a subtraction value Sub of 96 LSB is obtained. For the second horizontal time 2nd HT, the subtraction value Sub of −32 LSB obtained in the first horizontal time 1st HT is reflected in a first period ¾ HT and is not reflected in the remaining second period ¼ HT.

Since the data voltage has been changed for the second horizontal time 2nd HT, the selector SEL can output a data signal 192 LSB changed by reflecting (224−32 LSB) the subtraction value Sub of −32 LSB in the data signal Data1 (224 LSB) of the second latch 145 along with the data signal 224 LSB that is not changed.

As a result, changed data voltages Vdata can be output as 3 V (corresponding to the first period) and 3.5 V (corresponding to the second period) and data voltages Vdata actually applied to the display panel can appear as 3.6 V (corresponding to the first period) and 3.56 V (corresponding to the second period).

As illustrated in FIG. 15, when the data voltages are output as described above, a voltage difference ΔVdata of about −0.5 V can be present in a transition from the first horizontal time 1st HT to the second horizontal time 2nd HT, a voltage difference ΔVdata of about 1.5 V can be present in a transition from the second horizontal time 2nd HT to the third horizontal time 3rd HT, and a voltage difference ΔVdata of about −0.5 V can be present in a transition from the third horizontal time 3rd HT to the fourth horizontal time 4th HT.

As can be ascertained from the example in which data voltages are changed for the first horizontal time 1st HT and the second horizontal time 2nd HT, according to the third embodiment of the present invention, a data voltage variation per horizontal time can be previously reflected in the first period ¾ HT that is the initial period of each horizontal time 1 HT. Accordingly, the data voltage Vdata to be output for the second horizontal time 2nd HT, 3.5 V, is output as 3 V in the first period ¾ HT of the second horizontal time 2nd HT because the data voltage Vdata is changed and output as 3.5 V in the second period ¼ HT of the second horizontal time 2nd HT because the data voltage Vdata is not changed.

Although the first to third embodiments of the present invention have been described as different embodiments, one or more of the embodiments can be combined in consideration of the structure, charging characteristics, driving method, and implementation method of the display device.

Figure 16:
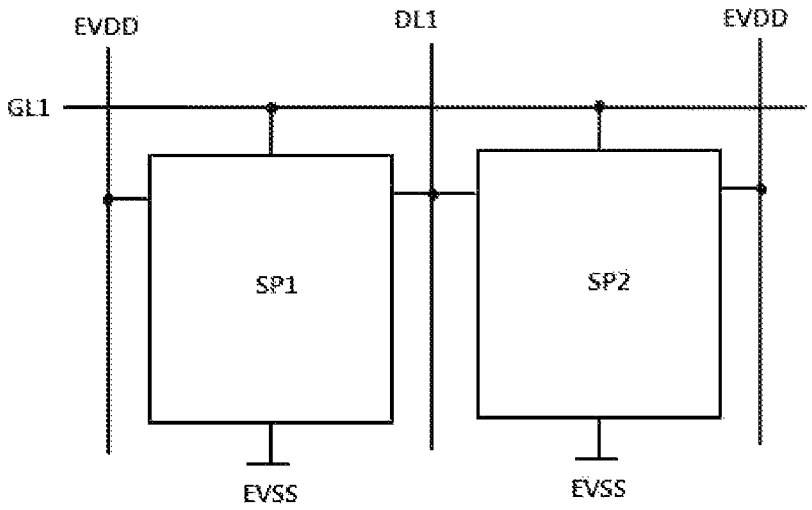
FIG. 16 illustrates a sub-pixel structure that can obtain advantages according to an embodiment of the present disclosure

FIG. 16 illustrates a sub-pixel structure that can obtain advantages when the present invention is applied thereto according to an embodiment.

FIG. 16 illustrates an example of a sub-pixel structure in which at least two neighboring sub-pixels SP1 and SP2 share a single data line DL1. The sub-pixel structure shown in FIG. 16 can have the advantage of reducing the number of output channels of the data driver as compared to the sub-pixel structure as shown in FIG. 2.

As described above, the present invention can improve a charging rate of data voltages output from the data driver using a difference between two consecutive data signals. Accordingly, the greater advantages can be obtained when the present invention is applied to the sub-pixel structure illustrated in FIG. 16 for the following reason.

In the output channel stage of the data driver, the sub-pixel structure as shown in FIG. 16 can cause load increase approximately twice that in the sub-pixel structure as shown in FIG. 2 and can have difficulty securing a charging rate according to the display panel size.

However, the present invention not only can improve the charging rate of data voltages output from the data driver but also can vary the charging rate according to the display panel size. Accordingly, the charging rate can be improved when the present invention is applied to the sub-pixel structure as shown in FIG. 2, and the charging rate can be improved and/or a certain level of charging rate can be secured without decreasing due to load increase when the present invention is applied to the sub-pixel structure as shown in FIG. 16. In other words, the present invention can improve the charging rate of data voltages or secure a certain level of charging rate when a large-screen/high-definition display device is realized.

Furthermore, the present invention can calculate differences between consecutive data signals and directly vary data voltages based on the differences in the data driver instead of the timing controller. Accordingly, it is not necessary to use an algorithm for recognizing an image data pattern to improve the charging rate of data voltages or to vary data voltages, and when the algorithm is included in the timing controller, the algorithm can be eliminated.

As described above, the present invention has the advantage of improving the charging rate of data voltage output from the data driver or securing a certain level of charging rate using a difference between two consecutive data signals. In addition, the present invention has the advantage of improving the charging rate of data voltage output from the data driver and varying the charging rate according to the display panel size. Furthermore, the present invention can have the advantage of improving the charging rate of data voltages or securing a certain level of charging rate to easily realize a large-screen/high-definition display device.

What is claimed is:

1. A display device comprising:

a display panel configured to display images; and a data driver configured to:

receive digital data signals, determine a difference value between two consecutive data signals for data voltages to be output based on the digital data signals, change a voltage of the data voltages based on the difference value to generate a changed data voltage, and output the changed data voltage, wherein the changed data voltage is output during a horizontal time period corresponding to driving one line.

2. The display device according to claim 1, wherein the changed data voltage is output during an initial period of the horizontal time period, and wherein the initial period starts at a beginning of the horizontal time period and is shorter than the horizontal time period.

3. The display device according to claim 1, wherein the changed data voltage is output during a fixed period or a variable period within the horizontal time period.

4. The display device according to claim 1, wherein the data driver includes:

a first circuit configured to subtract a first data signal stored in a second latch from a second data signal stored in a first latch to generate the difference value; and a second circuit configured to output the changed data voltage based on the difference value.

5. The display device according to claim 4, wherein the second circuit is further configured to:

output the changed data voltage during a first period within the horizontal time period, and output the first data signal stored in the second latch during a second period of the horizontal time without changing the first data signal.

6. The display device according to claim 4, wherein the first circuit includes:

a subtractor configured to subtract the first data signal stored in the second latch from the second data signal stored in the first latch to generate the difference value; and a delay circuit portion configured to receive the difference value from the subtractor and output the difference value at a delayed timing, and wherein the second circuit includes:

an adder configured to generate the changed data voltage based on adding the difference value output from delay circuit portion to the first data signal output from the second latch; and a selector configured to output the first data signal stored in the second latch without changing the first data signal or output the changed data voltage generated by the adder.

7. The display device according to claim 6, wherein the selector is further configured to select the first data signal stored in the second latch or the changed data voltage generated by the adder based on a circuit control signal received from a timing controller.

8. The display device according to claim 7, wherein the second circuit is further configured to:

fix or vary a timing in which the difference value is reflected in the first data signal stored in the second latch based on the circuit control signal.

9. The display device according to claim 1, wherein the data driver outputs at least two different voltage levels to the one line during the horizontal time period.

10. A method for driving a display device including a display panel configured to display images and a data driver configured to drive the display panel, the method comprising:

subtracting, by the data driver, a first data signal stored in a second latch of the data driver from a second data signal stored in a first latch of the data driver to generate a difference value;

generating, by the data driver, a changed data voltage based on the difference value; and converting, by a digital to analog (DA) converter in the data driver, the changed data voltage into an analog data voltage and outputting the analog data voltage to the display panel.

11. The method according to claim 10, further comprising:

selectively outputting, by the data driver, the changed data voltage or the first data signal stored in the second latch without changing the first data signal.

12. The method according to claim 10, wherein the changed data voltage is output during a horizontal time period corresponding to driving one line.

13. The method according to claim 12, further comprising:

outputting, by the data driver, at least two different voltage levels to the one line during the horizontal time period.

14. The method according to claim 10, wherein the changed data voltage is output during a fixed period or a variable period within the horizontal time period.

15. The method according to claim 10, wherein the changed data voltage is output during an initial period of the horizontal time period, and wherein the initial period starts at a beginning of the horizontal time period and is shorter than the horizontal time period.

16. A display device comprising:

a display panel configured to display an image; and a data driver configured to:

receive digital data signals from a timing controller, change a voltage of data voltages to be output to the display panel based on a difference value between two consecutive data signals among the digital data signals to generate a changed data voltage, and output the changed data voltage to the display panel, wherein the changed data voltage is output during a horizontal time period corresponding to driving one line.

17. The display device according to claim 16, wherein the data driver outputs at least two different voltage levels to the one line during the horizontal time period.

18. The display device according to claim 16, further comprising:

a selector configured to:

receive a control signal from the timing controller, and output the changed data voltage or an unchanged data voltage based on the control signal received from the timing controller.

* * * * *